United States Patent [19]

Johnson

[11] Patent Number: 5,043,761

[45] Date of Patent: Aug. 27, 1991

[54] MULTICOLOR IMAGE FORMING APPARATUS HAVING TRANSFER ROLLER FOR REGISTERING SINGLE COLOR IMAGES

[75] Inventor: Kevin M. Johnson, Rochester, N.Y.

[73] Assignee: Eastman Kodak Company, Rochester, N.Y.

[21] Appl. No.: 491,028

[22] Filed: Mar. 9, 1990

[51] Int. Cl.[5] ..... G03G 15/01

[52] U.S. Cl. ..... 355/326; 355/271; 355/277; 355/281; 355/327

[58] Field of Search ..... 355/271, 272, 273, 275, 355/277, 279, 280, 281, 326, 327, 328

[56] References Cited

U.S. PATENT DOCUMENTS

| | | | |
|---|---|---|---|
| 3,801,197 | 4/1974 | Akiyama et al. | 355/279 X |
| 3,957,367 | 5/1976 | Goel | 355/281 |
| 4,914,482 | 4/1990 | Ammenheuser et al. | 355/271 |

FOREIGN PATENT DOCUMENTS

| | | | |
|---|---|---|---|
| 0281055 | 2/1988 | European Pat. Off. . | |
| 0037041 | 3/1977 | Japan | 355/271 |
| 0217078 | 9/1986 | Japan | 355/271 |
| 0219073 | 9/1986 | Japan | 355/271 |
| 63-64065 | 3/1988 | Japan . | |

*Primary Examiner*—A. T. Grimley
*Assistant Examiner*—Thu Anh Dang
*Attorney, Agent, or Firm*—Leonard W. Treash, Jr.

[57] ABSTRACT

A multicolor image forming apparatus forms a series of electrostatic images on an image member and tones those images with different colored toners. The toners are transferred in registration to a portion of a continuous web receiving sheet by securing the portion of the web to a transfer roller and moving the transfer roller in a first direction to receive an image and in a second direction to return the portion of the web to a position for receiving a second web image in registration. Movement of the transfer roller during transfer is controlled by the image member. In between transfers movement of the transfer is controlled by a first stepper motor which disengages and engages the transfer roller from the image member and a second stepper motor which resets the transfer roller to its beginning position. The reset motor also brings the transfer roller up to the speed of the image member before reengagement.

17 Claims, 5 Drawing Sheets

MULTICOLOR IMAGE FORMING APPARATUS HAVING TRANSFER ROLLER FOR REGISTERING SINGLE COLOR IMAGES

TECHNICAL FIELD

This invention relates to apparatus for forming multicolor toner images on a receiving web. It is particularly usable in high-quality electrophotographic color imaging apparatus.

BACKGROUND ART

Conventional electrophotographic color apparatus forms two or more single color images on a photoconductive image member and transfers those images in registration to a receiving sheet. The receiving sheet is generally a cut sheet which has been positioned on the periphery of a roller. The roller rotates in contact or at least in transfer relation with the photoconductive member to bring the sheet through such transfer relation once for each color image to form a multicolor image.

When cut sheets of varying size are to be received by a transfer roller, multiple sets of gripping means must be provided. For example, if vacuum holes are used, typically a single set of holes grips the leading edge of each sheet, but a different set is necessary for the trailing edge of each different size. Vacuum holes create problems in transfer, both electrostatic field and thermal transfer for the portion of the image over the holes. Leading and trailing edge holes actually used can be positioned in margins, if margins are acceptable, but other sets occur in image areas if varying sizes are to be accommodated.

In the photographic printing art it is known to use continuous webs of photographic paper to form prints of different size for later cutting. Thus, a single roll of paper can be used to form a variety of sizes of photographic prints. The necessity of rotating the receiving sheet through the transfer zone once for each color in electrophotography has always prohibited use of this feature in such apparatus.

Japanese Kokai 63-64065 laid-open Mar. 22, 1988 discloses a continuous web color electrophotographic apparatus in which a web is fed using a pair of feed rollers through transfer relation with the photoconductor. The feed rollers are then reversed first to feed the web back to its starting point and second for re-movement through the transfer position to receive a second image. Registration is maintained by lining up marks on the photoconductor and the web for each transfer.

Accurate registration using marks on the photoconductor and the web with feed rollers requires accurate sensing devices and accurate control which, to say the least, stretches the technology for highest quality work. Perhaps more significant for high quality work, no web tracking device can prevent some crosstrack misalignment and skew between images, each of which will impart misregistration to the ultimate multicolor images.

DISCLOSURE OF THE INVENTION

It is the object of the invention to provide a multicolor toner image forming apparatus in which electrostatic images are formed on an image member and toned with different colors to create toner images as in the prior art, but the images are transferred to a portion of a continuous web receiving sheet with substantially improved reliability in registration.

This and other objects are accomplished by apparatus generally of the type described, but which includes a transfer roller and means for securing a discrete portion of a continuous transfer web to the periphery of the roller. The transfer roller is rotatable in a first direction to bring the portion of the web through a transfer zone in transfer relation with the image member and in a second direction to return the portion to a position for again bringing the transfer portion through said transfer zone to transfer a plurality of images in registration to the portion of the web.

According to a preferred embodiment the roller is separatable from the image member for movement in its second direction and is moveable into engagement with the image member for movement by the image member in its first direction.

According to another preferred embodiment both the translational movement away from the image member and the movement in the second direction are controlled by stepper motors.

According to another preferred embodiment the means for moving the roller in its second direction, for example, an appropriate stepper motor, is reversible for rotating the roller in its first direction so that it is moving with the image member as it engages it.

With the above structure a quality of registration can be maintained with continuous web receiver that is comparable to the quality maintained with cut sheets. Multicolor images can be produced that are comparable to what is traditionally considered photographic quality with the flexibility of cutting the images after formation.

Using vacuum holes to hold the portion of the receiver receiving an image, a variety of sizes of images can be transferred with only two sets of holes. A result not usually possible with cut sheets. Further, those two sets of holes can be outside the image areas without wasting the receiver or requiring margins.

BRIEF DESCRIPTION OF THE DRAWINGS

In the detailed description of the preferred embodiment of the invention presented below, reference is made to the accompanying drawings, in which.

BEST MODE OF CARRYING OUT THE INVENTION

Figure 1:
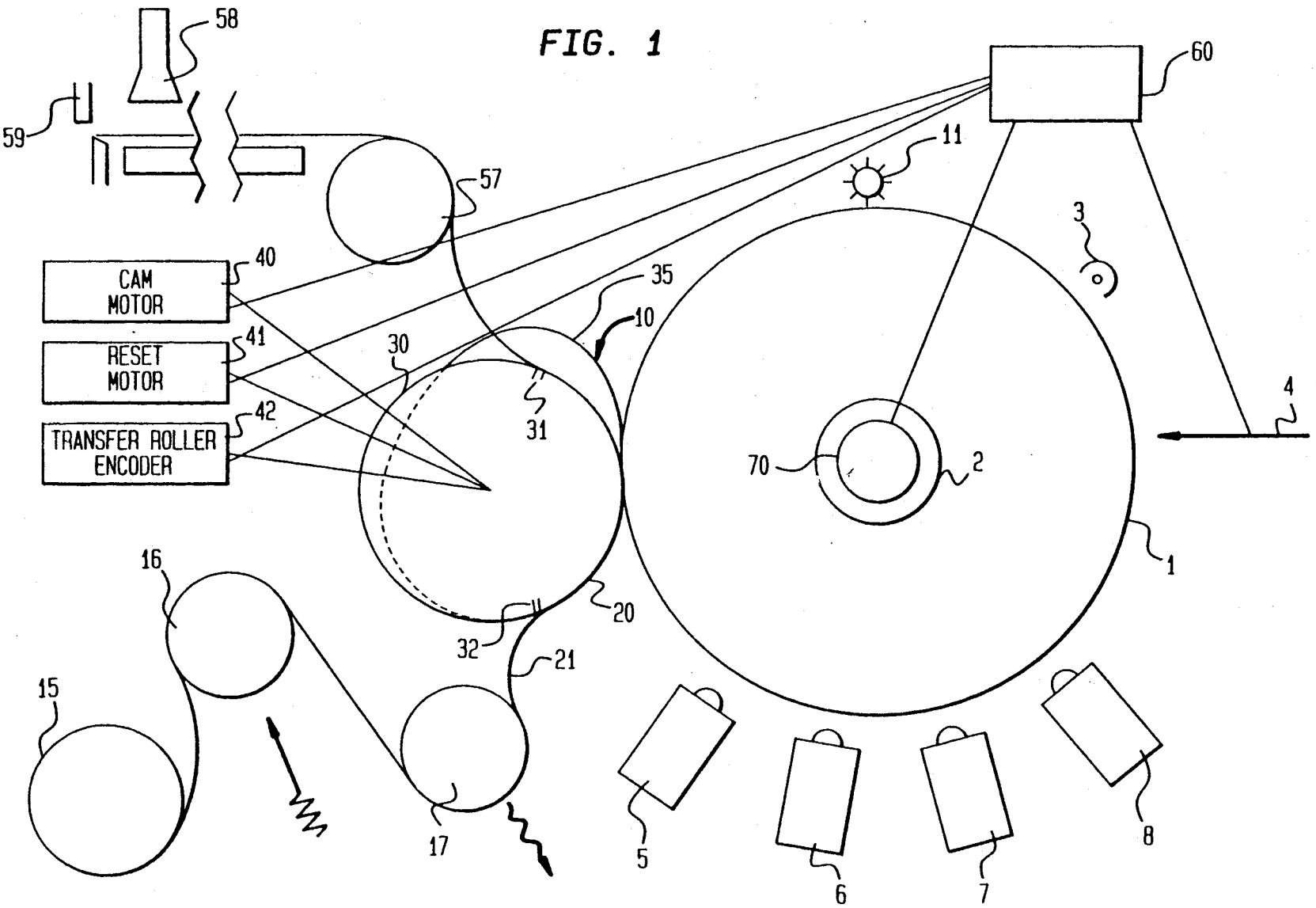
FIG. 1 is a side schematic of a multicolor image forming apparatus constructed according to the invention.

FIG. 1 shows an electrophotographic multicolor image forming apparatus including an image member, for example, a photoconductive drum 1 which is rotated by a motor 2 to move a photoconductive periphery through an endless path past a series of stations well-known in the art. The periphery of image member 1 is first uniformly charged at a charging station 3. It is exposed at an exposure station, for example, laser exposure station 4 to create an electrostatic image. This is repeated to form a series of electrostatic images representing color separations ultimately to define the final multicolor image. Each of the electrostatic images is toned by one of toning stations 5, 6, 7 or 8 to form a series of toner images of different color. The images are transferred in registration to a portion 20 of a receiving web 21 at a transfer station 10. After transfer, the photoconductive surface is cleaned by cleaning station 11 for reuse, as is well-known in the art. Continuous web 21 is supplied to transfer station 10 from a web supply 15 through appropriate tension controlling member 16 and 17.

Transfer station 10 includes in addition to image member 1, transfer roller 30. Transfer roller 30 includes means for securing portion 20 of web 21 to its periphery. For example, as seen in FIG. 1, portion 20 is secured to transfer roller 30 by sets of vacuum holes 31 and 32. Set 31 holds the leading part of portion 20 and set 32 holds the trailing part. A cam 35 is mounted coaxially with roller 30 and rides on a portion of the periphery of image member 1 that is not image bearing. Transfer roller 30 rotates in a first direction, counterclockwise in FIG. 1, when an image is being transferred.

A cam motor, a reset motor, and, optionally, an encoder are also associated with the shaft associated with roller 30. The operation of the motors will be more clear with an explanation of FIG. 2. However, in summary, the cam motor rotates cam 35 to move the roller toward and away from image member 1. The reset motor rotates roller 30 in a second direction opposite the first direction. The encoder can be used to synchronize the exposure at exposure station 4 so that a plurality of images can be formed at a position on the periphery of image member 1 that will assure their transfer in registration to web portion 20.

After transfer a vacuum roller 57 holds web 21 with the vacuum at sets of holes 31 and 32 turned off while roller 30 is rotated in a clockwise direction to index web 21 to bring the next portion to receive an image to an operative position. If only a small portion of portion 20 is imaged, the web 21 will be indexed only according to the size of that portion and any intended margin. This will leave some of the old portion 20 in the new portion 20. No margin between images is necessary for transfer although a margin on the sides may be desirable to actuate a cutting operation later, and a small margin between images may allow useful tolerance in cutting. No transfer need be done to a receiving part backed by vacuum holes.

From vacuum roller 57 the web proceeds to an infrared fuser 58 and a cutter 59. Cutting can be done in response to marks on the edge of the web created in the imaging process as is well known in the photographic imaging art, by hand, or by other known automatic means. If roller fusing or fixing is used it may be desirable to cut the web prior to fusing unless the fuser and transfer station operate at the same speed. Control of a cut sheet in a pressure roller fixing device is somewhat easier than control of an uncut web.

Figure 2:
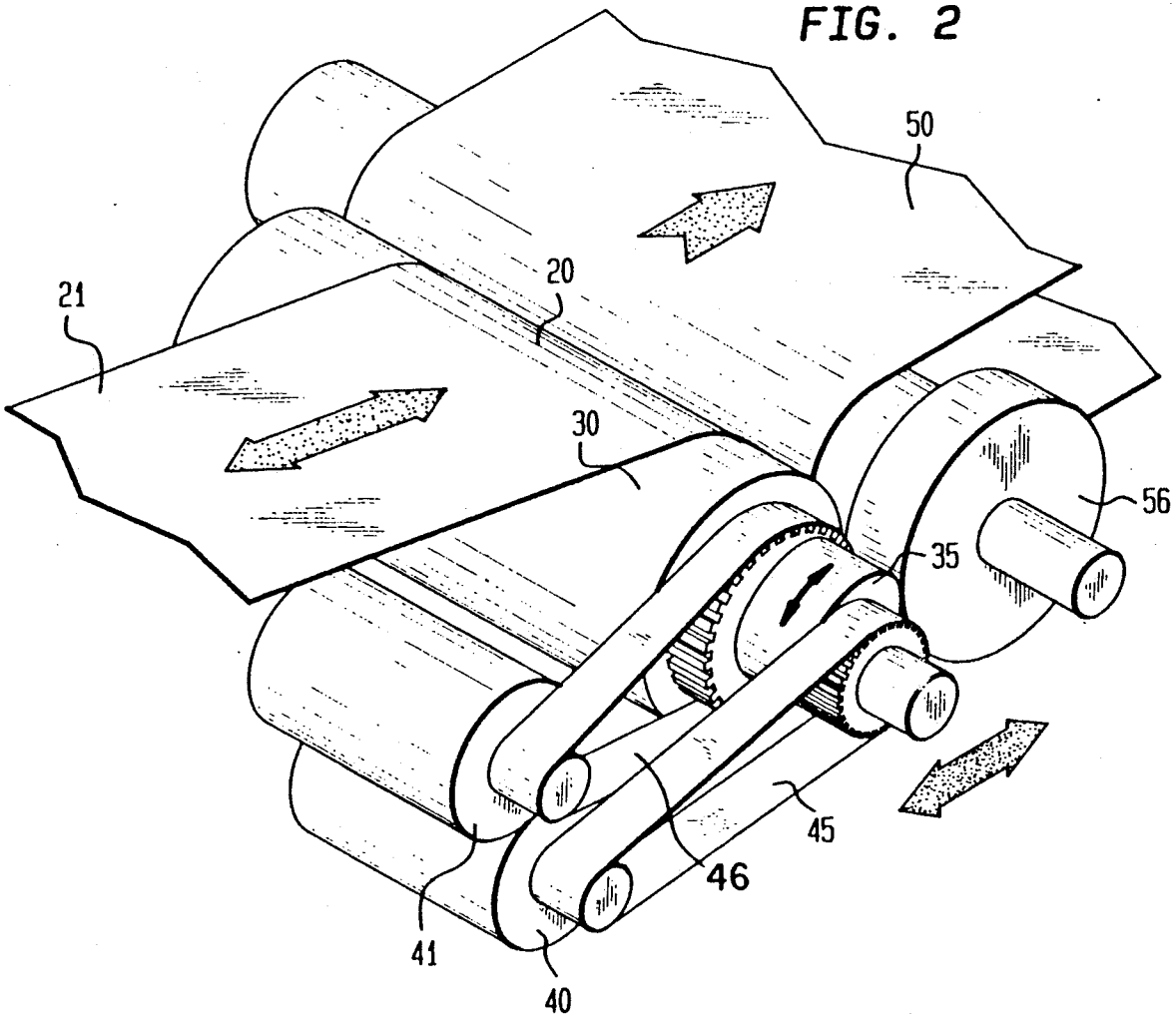
FIG. 2 is a perspective view of a transfer portion of an embodiment of the invention slightly different from that shown in FIG. 1.
Figure 3:
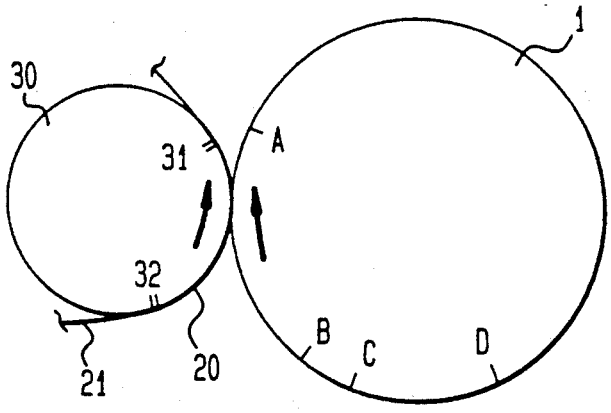
FIGS. 3, 4, 5 and 6 are diagrams with many parts eliminated illustrating the movement of a transfer roller according to the invention.

FIG. 2 shows a slightly different embodiment of the apparatus shown in FIG. 1 in which the image member is an endless belt 50 which has passed through essentially the same stations shown in FIG. 1 to create consecutive different colored toner images which are to be transferred in registration to portion 20 of a continuous web 21. FIG. 2 illustrates the function of the cam motor and the reset motor to control the movement of transfer roller 30 in both FIG. 1 and FIG. 2 embodiments. Belt 50 is backed by back-up roller 56 at the transfer station.

Cam motor 40 is a stepper motor which is connected by a timing belt 45 to cam 35 to rotate cam 35 to move roller 30 toward and away from the image member, that is, endless belt 50 and back-up roller 56. Reset motor 41 is a stepper motor which is connected by a timing belt 46 directly to the shaft of transfer roller 30 and is capable of rotating transfer roller 30 in either direction. It is primarily used to rotate the transfer roller 30 in a resetting second direction opposite to the direction of movement of endless web 50 (and drum 1 in FIG. 1). The coupling between stepper motor 41 and transfer roller 30 is disengagable to permit the transfer roller to be driven by engagement with either image member 1 or 50.

FIGS. 3, 4, 5 and 6 illustrate the movement of the transfer roller. According to FIG. 3 image member 1 contains two toner images, one of one color extending from point A to point B and a second of a different color extending from point C to point D. Third and fourth images that also make up the ultimate multicolor image are not shown. The web 21 has been positioned around transfer roller 30 and portion 20 is held by sets of vacuum holes 31 and 32. The vacuum holes are preferably outside the proposed image area. If the images are small, say 4 inches in length, one or both sets of vacuum holes are far outside the image area. Roller 30 is rotated in a counterclockwise direction by engagement with drum 1 bringing the first toner image into transfer relation with portion 20. Transfer is effected by any of several means well-known in the art, for example, by an electrostatic field or by heat.

Figure 4:
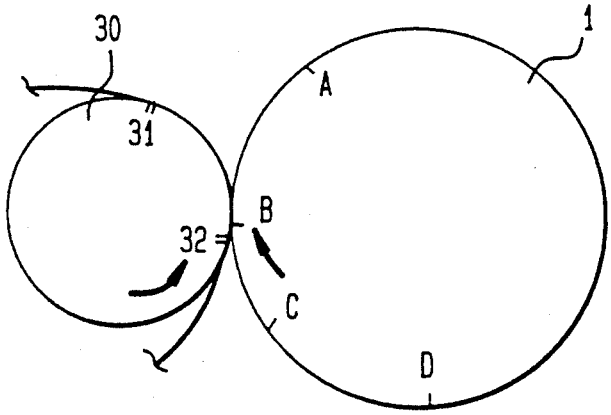
Figure 5:
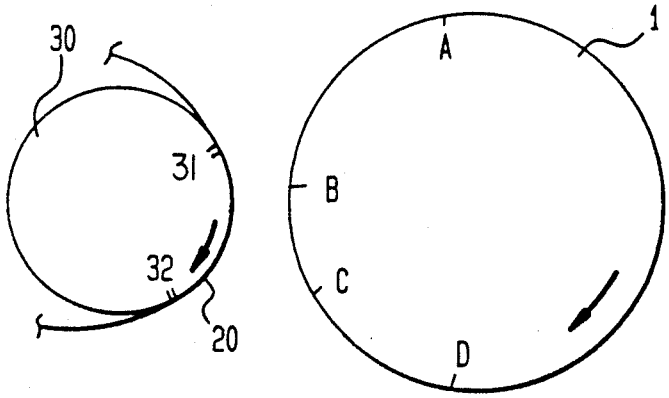

As the image member 1 rotates the transfer roller 30 it reaches the position shown in FIG. 4 in which the entire image has been transferred to portion 20. At this point, the cam motor 40 (FIG. 2) is engaged rotating cam 35 to a position separating roller 30 from image member 1. As the transfer roller 30 becomes disengaged from image member 1 reset motor 41 is engaged to rotate transfer roller 30 in its second direction, clockwise as seen in the Figs., to reset portion 20 as shown in FIG. 5. As portion 20 reaches its furthest position with the leading portion of portion 20 well past a point opposite the point of engagement with image member 1, cam motor 40 is reengaged to drive transfer roller 30 in a reverse direction to permit roller 30 to reengage with image member 1.

Figure 6:
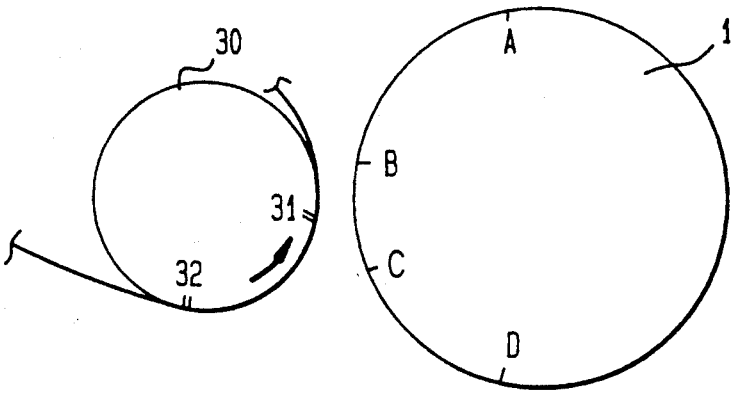

As shown in FIG. 6, as transfer roller 30 approaches engagement with image member 1 reset motor 41 is also reversed so that portion 20 is moving at the same speed and direction as image member 1 before they engage to prevent sliding movement between the two surfaces. If the roller 30 is brought up to the exact speed of the image member prior to reengagement the actuation of cam motor 40 is not critical to registration of the images. Actuation and speed of the reset motor is critical but is dependent on the relative angular positions of the roller and drum, positions much easier to control than is peripheral engagement. With the preciseness and reliability of the roller and the reset stepper motor, registration approximating that with cut sheets is attainable.

The encoder 42 can be used to input the rotational position of the transfer roller 30 to a logic and control 60 which in turn controls exposure station 4 in response to such input.

Figure 7:
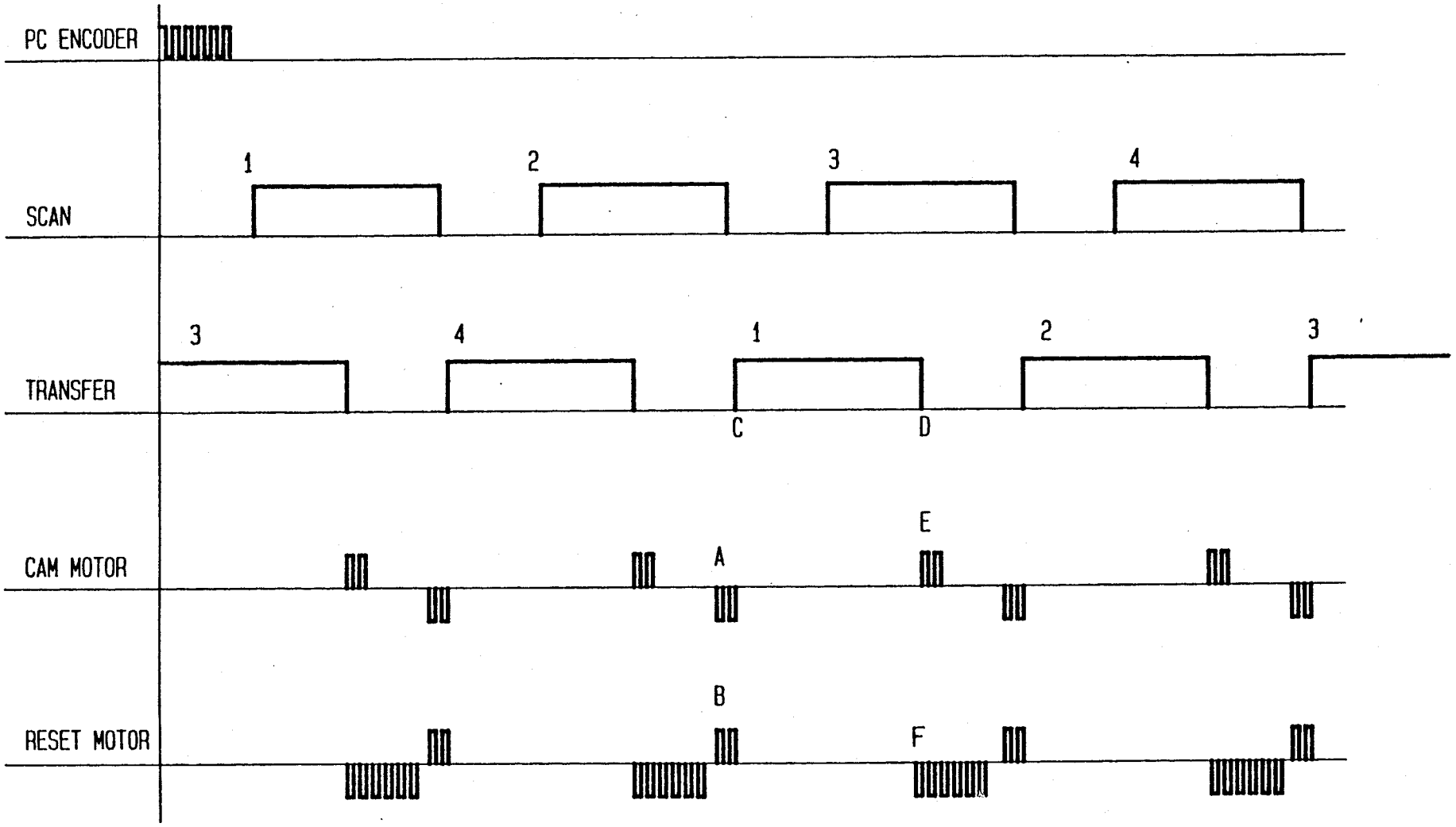
FIG. 7 is a timing chart for the apparatus shown in FIG. 1.

Alternatively, a drum encoder 70 may provide a continuous stream of pulses related to the angular position of drum 1 off which the entire system is timed. Such timing is illustrated in FIG. 7 which is a timing chart for the FIG. 1 apparatus using signals from encoder 70 on drum 1 as the basis for such timing. Logic and control 60 has a computer clock which provides clock pulses for precise timing. Pulses from encoder 70 are overlaid on the clock pulses and determine the start of scan signal for exposure station 4. Actuation of both the cam motor and the reset motor are controlled by the pulses from encoder 70 using the clock pulses for control between encoder pulses. According to the arrangement shown in FIG. 7 a start of scan signal occurs at regular intervals as timed by pulses from encoder 70. Thus, in the line labelled "scan" in FIG. 7 each scan is shown in a four scan series, each of the four scans being placed at regular intervals according to pulses from encoder 70.

The position of transfer roller 30 is controlled completely by cam motor 40 and reset motor 41 whose actions in turn are controlled by logic and control 60 in response to pulses from encoder 70. As shown in FIG. 7, a given number of pulses after the start of scan for scan number 1 cam motor 40 is actuated to rotate cam 35 to cause transfer roller 30 to engage drum 1. This start of rotation of cam motor 40 for engagement of transfer roller 30 is shown at A in FIG. 7. It is not critical to registration. While (or just before) cam motor 40 is moving roller 30 into engagement with drum 1, the direction of reset motor 41 is reversed from its resetting direction to bring the rotation of roller 30 in a counterclockwise direction up to the exact speed of drum 1. This reverse movement of reset motor 41 is begun at position B. Accuracy in starting the reset motor to rotate roller 30 in a first direction determines the registration of the transferred image. Drum 1 now drives transfer roller 30 and the image is transferred to receiving web portion 20 as shown on the line labelled transfer with transfer beginning at point C. Transfer finishes at point D. After transfer, cam motor 40 is again engaged to drive cam 35 in a direction opposite to the previous direction to separate transfer roller 30 from drum 1. Such movement begins at point E. As the transfer roller 30 and the drum 1 become disengaged the reset motor is engaged at point F to drive the transfer roller 30 in a clockwise direction until the leading edge of the image has overshot a position opposite engagement with drum 1. At which point the reset motor is stopped and cam motor A is ready to begin to engage transfer roller 30 and drum 1 and reset motor 41 is ready to drive roller 30 in its first direction in response to the proper pulses from encoder 70 to repeat the process for the next image.

With this approach extremely accurate registration can be maintained despite the complicated movement of transfer roller 30. Registration itself is dependent upon the preciseness of the movement of roller 30 by the reset motor in rotating the transfer roller 30 after the signal at point B. Such precision is within the capabilities of quality stepper motors which are preferred for this task. Thus, when image 2 is to be transferred the reset stepper motor has moved through the same distance between images in resetting roller 30 and is started off a comparable pulse from encoder 70 for each image. To adapt the apparatus for varying sized images, the movement of reset motor 41 is altered according to image length, varying the reset position, i.e., the position of the roller when point B is reached in timing. Because the web portion 20 is held by a roller, web tracking is not a factor in registration. Thus, skew and cross track registration are equivalent to that of cut sheet systems.

A transfer roller encoder 42 is also shown in the apparatus. It is not necessary in the above approach. However, it could be used in either of two ways. First, it can be used to control the reset stepper motor 41 to assure accurate position of roller 30 at time B and then movement in the first direction leading to engagement with drum 1. In such an embodiment, it works with encoder 70. Second, encoder 70 could be eliminated and the consistency of rotation of drum 1 relied upon by using the transfer roller encoder 42 to time not only the movements of the transfer roller but also the beginning of the scan for exposure station 4.

With this structure a continuous web can be used in high quality color electrophotography, permitting flexibility in producing a variety of size of images. For differing sizes, it is not necessary that a variety of sets of vacuum holes be placed in roller 30, since either set of vacuum holes can be spaced greater or lesser distance from the image as its size changes. The next image can be placed in part in an area that was between the sets of vacuum holes during transfer of the previous image.

Thus, an eight-inch wide receiving web can be used to make images three inches long for two three-by-four prints, 5 inches long for a five-by-seven (with cropping) and ten inches long for an eight-by-ten. To handle all of these sizes, sets of vacuum holes 31 and 32 should be greater than ten inches apart. Roller 30 rotates only the length of the images. The images can be formed with the same interframe distance on drum 1 regardless of size or varied to allow reset motor 41 more time for greater reset movement.

Note that roller 30 is shown as a complete roller in the Figs. However, only the section of roller 30 having vacuum holes 31 and 32 is used. Thus, roller 30 could, in fact, have a pie-shaped or semicircular cross-section and still function as a roller in this invention.

Figure 8:
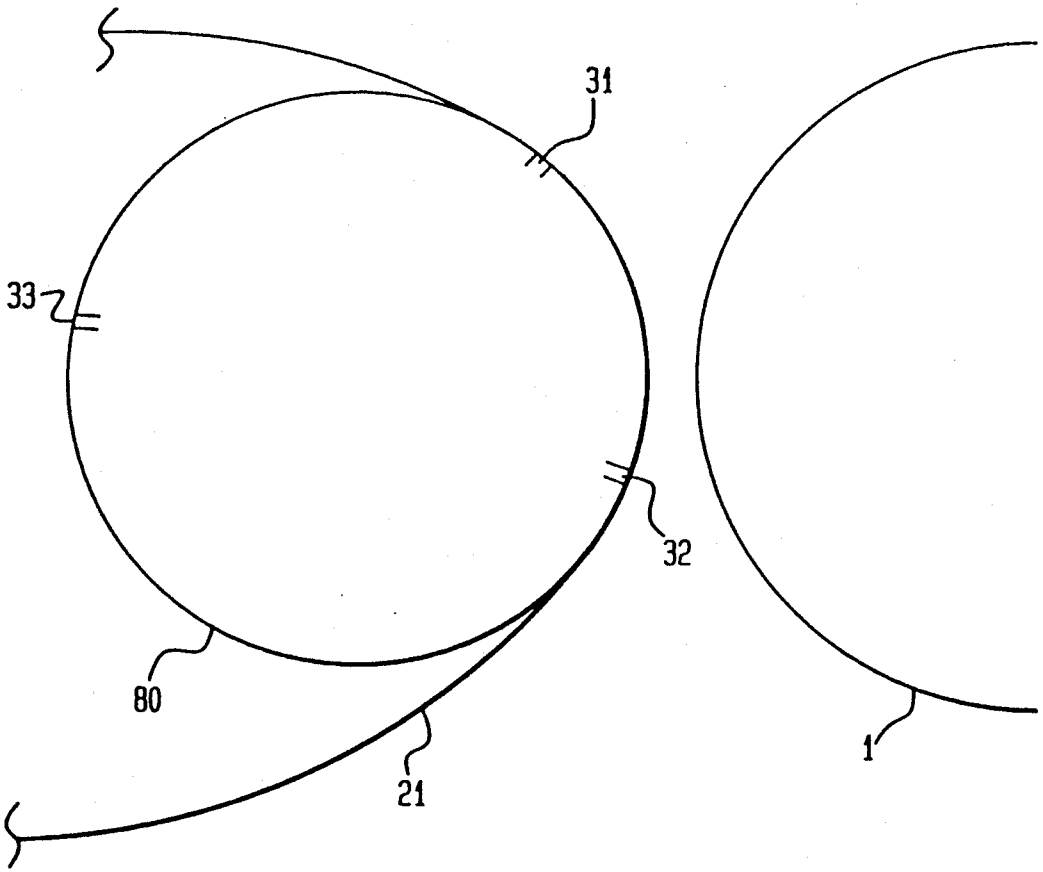
FIG. 8 is a side schematic of an apparatus substantially the same as that shown in FIG. 1 but with an alternative transfer roller.

It may be desirable in some configurations to hold the sheet 21 as close to the image as possible thus having a minimum portion of sheet 21 secured to the roller periphery at any one time. To do this and secure both the leading and trailing end of the secured portion of the web, varying size images requires a number of sets of vacuum holes. In the prior art, with cut sheets, some sets of vacuum holes end up underneath image areas, causing image artifacts. Elimination of such artifacts is a feature of the apparatus shown in FIGS. 1–7. However, FIG. 8 illustrates an alternative construction 80 for the transfer drum usable in the FIG. 1 apparatus, which has an extra set 33 of vacuum holes which, with sets 31 and 32 define three different lengths of the periphery of drum 30 between them. That is, a short length of web 21 is held using holes 31 at the leading end of the held portion and holes 32 at the trailing end. An intermediate length uses holes 33 to hold its leading end and holes 31 its trailing end. A long length uses holes 32 to hold the leading end and holes 33 the trailing end. With this structure a given set of vacuum holes would be used sometimes to hold the leading end and sometimes to hold the trailing end of the held portion of sheet 21.

Although FIG. 8 shows a scheme in which 3 sets of vacuum holes define 3 different lengths of periphery for holding the sheet 21, the transfer roller 30 in FIG. 1 construction could be used similarly with a 2 mode scheme. That is, vacuum holes 31 and 32 could operate in mode 1 as shown in FIG. 1. In mode 2 the roller is rotated until vacuum holes 32 are positioned to hold the leading portion of the sheet and vacuum holes 31 hold the trailing portion as the sheet is stretched clockwise from holes 32 to holes 31 around the large segment of the periphery of roller 30. It will be clear to a person skilled in the art that the more sets of vacuum holes on the transfer roller the more different lengths of non-overlapping periphery can be defined.

It should be pointed out that this FIG. 8 alternative in most instances would be unnecessary because the structure shown in FIG. 1, as described originally, permits varying lengths of images with only the single portion running clockwise from vacuum holes 31 to vacuum holes 32 being used to hold the sheet 21. The FIG. 8 approach would become desirable when, because of machine configurations or particular materials used, contacting the periphery of the roller with the sheet 21 over a minimum distance is desirable.

The FIG. 8 scheme could also be used for cut sheets as well as the continuous webs shown in FIGS. 1 and 8. However, using a unidirectionally rotating transfer roller, throughput would be substantially reduced because of the large unused portion of the periphery of the roller.

The invention has been described in detail with particular reference to a preferred embodiment thereof, but it will be understood that variations and modifications can be effected within the spirit and scope of the invention as described hereinabove and as defined in the appended claims. For example, although the invention has been designed for electrostatic imaging, such as electrophotography, with which it is particularly usable, it can also be applied to other systems in which a plurality of color images are transferred to or otherwise formed on a receiving sheet at a single location or nip. For example, it could be used in thermal dye transfer and other similar systems.

I claim:

1. Multicolor image forming apparatus comprising:

an image member moveable through an endless path, means for forming a plurality of electrostatic images on said image member as it moves through said path, said electrostatic images representing color separations of a multicolor image to be formed, means for applying toners of different color to said images to create a series of different color toner images, and transfer means for transferring said toner images in registration to a receiving web as said image member moves through said path to form a multicolor image, characterized in that said transfer means includes a transfer roller having a periphery and means for securing a discrete portion of a continuous transfer web to the periphery transfer, said transfer roller being rotatable in a first direction during which said portion of said web is moved through a transfer zone in transfer relation with said image member and in a second direction to return said portion to a position for again bringing said portion through said transfer zone, to transfer a plurality of images in registration to said portion of said web.

2. Apparatus according to claim 1 wherein said portion of said web is engageable by said image member as said image member moves through its endless path to rotate said transfer roller in said first direction while transferring a toner image to said portion of said web.

3. Apparatus according to claim 1 wherein said transfer roller is separable from said image member before rotation of said transfer roller in said second direction.

4. Apparatus according to claim 2 wherein said transfer roller is separable from said image member before rotation of said transfer roller in said second direction.

5. Apparatus according to claim 4 further including first means for driving said transfer roller out of engagement with said image member and into engagement with said image member and second means for rotating said transfer roller in said second direction.

6. Apparatus according to claim 5 wherein said second means is a stepper motor.

7. Apparatus according to claim 1 wherein said means for securing a portion of said web to said transfer roller is vacuum means.

8. Apparatus according to claim 5 wherein said second means for rotating said transfer roller in said second direction is reversible to rotate said transfer roller in said first direction prior to engagement of said transfer roller and said image member to equalize speed and direction of said image member and said transfer roller prior to their engagement.

9. Multicolor image forming apparatus comprising:

a photoconductive image member moveable through an endless path, means for uniformly charging said image member, means for imagewise exposing said image member to create a series of electrostatic images as said image member moves through its path, said electrostatic images representing color separations of a multicolor image to be formed, means for applying toners of different colors to said images to create a series of different color toner images of variable size, and transfer means for transferring said toner images in registration to a receiving web as said image member moves through said path, characterized in that said transfer means includes a transfer roller having a periphery and means for securing a discrete portion of a continuous transfer web to the periphery, said transfer roller being rotatable in a first direction to bring said portion of said web through a transfer zone in transfer relation to said image member and in a second direction to return said portion to a position for again bringing said portion through said transfer zone to transfer a plurality of the images in registration to said portion of said web.

10. Apparatus according to claim 9 wherein said image member is in the form of a drum.

11. Apparatus according to claim 10 including means for sensing a rotational position of said drum and logic and control means for controlling movement of said transfer roller in response to said rotational position.

12. Apparatus according to claim 10 which apparatus includes an encoder for monitoring a rotational position of said image member and creating a series of pulses indicative of that position, logic and control for controlling movement of said transfer roller in response to said pulses, means for separating said roller from said drum after transfer of each image, and for reengaging said transfer roller and drum to effect the next transfer, a stepper motor for rotating said drum in said second direction, said stepper motor being reversible to rotate said drum in a first direction at a speed equal to that of the drum before reengagement of said drum, said logic and control including means for triggering reverse movement of said roller in response to said rotational position of said drum.

13. Apparatus according to claim 12 wherein said reverse movement is continued for a distance and said logic and control includes means for varying the distance of said reverse movement according to the size of said images.

14. Multicolor image forming apparatus comprising:

an image member movable through an endless path, means for forming a series of transferable color images on said image member, means for transerring said color images in registration to a receiving web as said image member moves through said path to form a multicolor image, characterized in that said transfer means includes a transfer roller having means for securing a discrete portion of continuous transfer web to the periphery of said roller, said transfer roller being rotatable in the first direction during which said portion of said web is moved through a transfer zone in transfer relation with said image member and in a second direction to return said portion to a position for again bringing said portion through said transfer zone, to transfer a plurality of images in registration to said portion of said web.

15. A transfer roller having a periphery, said roller being adapted for use in a multicolor image forming apparatus of a type in which a series of color images are transferred in registration to a portion of a receiving sheet which portion has a leading part and a trailing part, and which portion is repeatedly transported through transfer relation with said images, leading part first, while being secured to the periphery of said roller, said roller comprising:

first circumferentially spaced set of vacuum holes and second cirsumferentially spaced set of vacuum holes for securing said receiving sheet at circumferentially spaced positions on the periphery of said roller, said sets of vacuum holes defining between them at least two different not overlapping circumferential lengths of said periphery, and said roller having a plurality of modes of operation, one in which said first set of vacuum holes holds the leading part of the receiving sheet portion and the second set of vacuum holes holds the trailing part, and the receiving sheet portion extends in a clockwise direction from said first set of vacuum holes to the second set of vacuum holes, and a second mode of operation in which said second set of vacuum holes holds the leading part of the receiving sheet portion and the first set of vacuum holes holds the trailing part and the receiving sheet portion extends in a clockwise direction around said periphery from said second set of vacuum holes to the first set of vacuum holes.

16. A multicolor image forming apparatus comprising:

an image member movable through an endless path, means for forming a plurality of electrostatic images on said image member as it moves through said path, said electrostatic images representing color separations of a multicolor image to be formed, means for applying toners of different color to said images to create a series of different color toner images, and transfer means for transferring said toner images in registration to a receiving web as said image member moves through said path to form a multicolor image, characterized in that said transfer means includes a transfer roller having a periphery and means for securing a discrete portion of a continuous transfer web to the periphery of said roller, said transfer roller being rotatable in a first direction during which said portion of said web is moved through a transfer zone and transfer relation with said image member and in a second direction to return said portion to a position for again bringing said transfer portion through said transfer zone, to transfer a plurality of images in registration to said portion of said web, said means for securing a discrete portion of continuous transfer web to the periphery of said roller including circumferentially spaced securing means which define at least 2 different not overlapping circumferential lengths of said periphery which lengths are alternatively usable to secure different discrete lengths of portions of a continuous transfer web.

17. A transfer roller having a periphery for a use in a multicolor imaging forming apparatus of a type in which a series of color images are transferred in registration to a portion of a receiving sheet which portion has a leading part and a trailing part and which portion is repeatedly transported through transfer relation with said images, leading part first, while being secured to the periphery of said roller, said roller comprising:

means for securing said receiving sheet at circumferentially spaced positions on the periphery of said roller, said securing means defining between them at least first circumferentially spaced set of vacuum holes, second circumferentially spaced set of vacuum holes, and third circumferentially spaced set of vacuum holes, and said roller having at least three modes of operation, a first mode in which said first set of vacuum holes holds the leading part of the receiving sheet portion and the second set holds the trailing part of the receiving sheet portion and the receiving sheet portion extends in a clockwise direction around said periphery from the first set of vacuum holes to the second set of vacuum holes, a second mode of operation in which the second set of vacuum holes holds the leading part of the receiving sheet portion and the third set of holes holds the trailing part of said receiving sheet portion and the receiving sheet portion extends in the clockwise direction around said periphery from the second set of vacuum holes to the third set of vacuum holes and a third mode of operation in which the third set of vacuum holes holds the leading part of the receiving sheet portion and the first set of vacuum holes holds the trailing part of said receiving sheet portion and the receiving sheet portion extends in the clockwise direction around said periphery from the third set of vacuum holes to the first set of vacuum holes.

* * * * *